US006769441B2

(12) United States Patent
Liu

(10) Patent No.: US 6,769,441 B2
(45) Date of Patent: Aug. 3, 2004

(54) FASTENING STRUCTURE OF UMBRELLA

(76) Inventor: Fu-Tien Liu, P.O. Box No. 6-57, Chung-Ho, Taipei (TW), 235

( * ) Notice: Subject to any disclaimer, the term of this patent is extended or adjusted under 35 U.S.C. 154(b) by 166 days.

(21) Appl. No.: 10/054,929

(22) Filed: Jan. 25, 2002

(65) Prior Publication Data

US 2003/0205263 A1 Nov. 6, 2003

(51) Int. Cl.[7] ..... A45B 25/06; A45B 25/08
(52) U.S. Cl. ..... 135/28; 135/38
(58) Field of Search ..... 135/28, 29, 38, 135/39, 41, 98

(56) References Cited

U.S. PATENT DOCUMENTS 742,177 A * 10/1903 Flad
897,026 A * 8/1908 Seitzinger
973,222 A * 10/1910 Schroeder
1,387,146 A * 8/1921 Folwell
1,593,494 A * 7/1926 Henry
1,919,610 A * 7/1933 Wery
4,038,997 A * 8/1977 Smith
5,193,566 A * 3/1993 Chen
6,286,530 B1 * 9/2001 Hussey

* cited by examiner

*Primary Examiner*—Robert Canfield
(74) *Attorney, Agent, or Firm*—Troxell Law Office PLLC

(57) ABSTRACT

A fastening structure of an umbrella for specifically stabilizing an umbrella post when opening a multiple-fold umbrella is mainly featured that an extending rod is disposed at a connected end of a strutting rib and a lower nest of the multiple-fold umbrella; the said extending rod penetrates directly into an inner hole of the lower nest through a radial channel disposed correspondingly on the lower nest and is supported on the umbrella post; thereby the umbrella post is stabilized relatively to the lower nest to assure that the fastener for opening the umbrella specifically supports the lower nest for a smooth umbrella opening operation; furthermore, the structure of the present invention is simple, convenient, efficient and meets all the requirements of the economic effect.

4 Claims, 6 Drawing Sheets

FASTENING STRUCTURE OF UMBRELLA

BACKGROUND OF THE INVENTION

1) Field of the Invention

The present invention relates to a fastening structure of an umbrella, more especially to an opening fastener for specifically stabilizing an umbrella post when opening an umbrella.

2) Description of the Prior Art

Various styles of one-fold or multiple-fold umbrellas are available on the market; especially, the multiple-fold umbrella becomes very popular and is preferred by more customers because it is foldable for storage and convenient for carriage; however, although the multiple umbrella is capable of achieving the efficiency of reducing the umbrella volume and conveniencing the storage, the multiple-fold umbrella post has a plurality of segments of post tubes; the aperture of the outmost post tube is the largest one and that of the inmost post tube is the smallest; when opening the umbrella, since the aperture of an inner hole of a lower nest is even larger than that of the largest post tube, the engagement between an inner tube with smallest aperture and the inner hole of the lower nest will leave a larger gap inbetween; thereby, the umbrella post inside the inner hole of the lower nest tends to swing and deviate; therefore, the supporting surfaces between the opening fastener on the umbrella post and the lower nest fail to engage and the fastener also fails to specifically support the lower nest; that causes the lower nest to slide downward and fails to achieve the objective of opening the umbrella for being ready right away for use.

SUMMARY OF THE INVENTION

The objective of the present invention is to overcoming the shortcomings of the available techniques by providing a fastening structure capable of specifically stabilizing an umbrella post of an umbrella.

The present invention comprises an upper nest, a lower nest, an umbrella post, an inner main rib, a strutting rib, a fastener for opening an umbrella and an outer main rib; the upper nest and one end of the umbrella post are fixedly connected; the umbrellas post penetrates through the inner hole of the lower nest to slidably connect with the lower nest; one end of the inner main rib pivotally connects with the upper nest and the other end thereof is pivotally connected to the middle portion of the strutting rib; the strutting rib can be an U-shaped rod or a solid rod; one end of the strutting rib pivotally connects with the lower nest and the other end thereof is pivotally connected with the outer main rib which is used to support a canopy; a radial channel is disposed at the jointed area between the lower nest and the strutting rib; the jointing end of the strutting rib is disposed with an extending rod which can be unitarily molded or hinged together with the strutting rib; the extending rod directly penetrates into the inner hole of the lower nest through the radial channel of the lower nest to adequately support, stabilize and prevent the umbrellas post inside the inner hole of the lower nest from swinging and deviating as well as to enable the fastener for opening the umbrella to specifically support the lower nest; the end plane of said extending rod penetrated into the inner hole of the lower nest is arcuate; the number of the extending rod can be one, two or more to be disposed on different strutting ribs according to the situation of usage; furthermore, to cooperate with the extending rod, a corresponding radial channel is also disposed on the lower nest.

The advantages of this abovementioned structure are that the umbrella inside the inner hole of the lower nest will not swing because the disposition of the extending rod on the strutting rib and the penetration thereof into the inner hole of the lower nest support the umbrella; therefore, the fastener for opening the umbrella is capable of specifically supporting the lower nest and facilitating the umbrella opening operation; furthermore, the structure of the present invention is simple, convenient for use and meets all the requirements of the economic effect.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
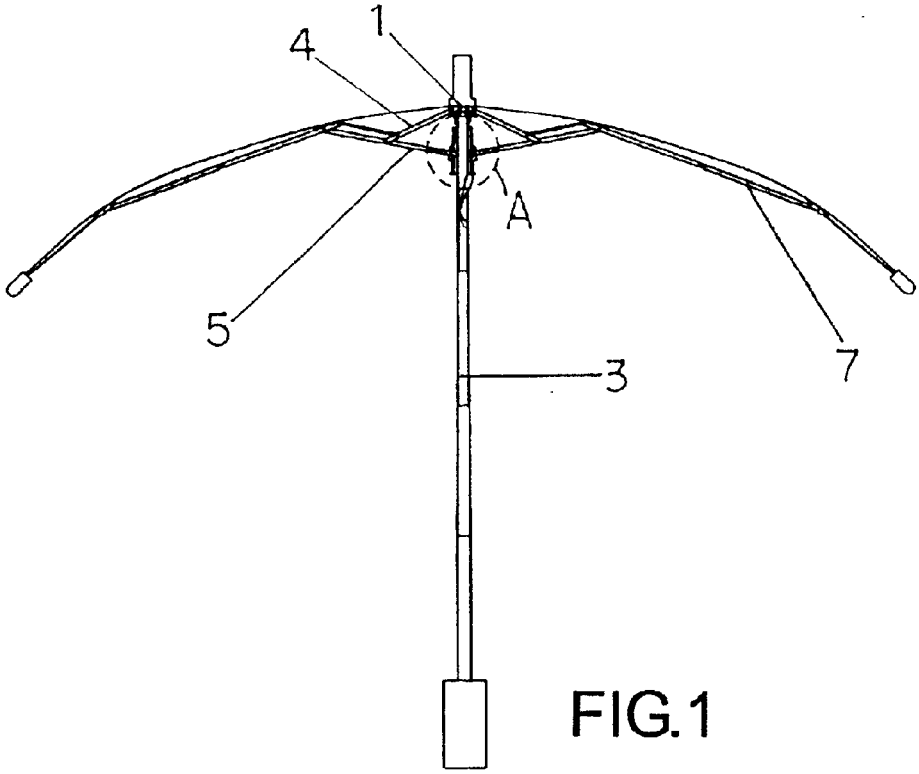
FIG. 1 is a schematic drawing of the practical and innovative umbrella opening of the present invention.

Referring to FIGS. 1–10, the present invention comprises an upper nest (1), a lower nest (1), an umbrella post (3), an inner main rib (4), a strutting rib (5), a fastener (6) for opening an umbrella and an outer main rib (7); the upper nest (1) and one end of the umbrella post (3) are fixedly connected; the umbrellas post (3) penetrates through the inner hole (21) of the lower nest (2) to slidably connect with the lower nest (2); a plurality of inner main ribs (4) are pivotally connected to the peripheral rim of the upper nest (1); the other end of the inner main rib (4) is pivotally connected to the middle portion of the strutting rib (5); the said strutting rib (5) can be an U-shaped rod or a solid rod; one end of the strutting rib (5) pivotally connects with the lower nest (2) and the other end thereof is pivotally connected with the outer main rib (7) which is used to support the canopy; a radial channel (22) is disposed at the jointed area between the lower nest (2) and the strutting rib (5); the jointing end of the strutting rib (5) is disposed with an extending rod (51) which can be unitarily molded or hinged together with the strutting rib (5); the extending rod (51) directly penetrates into the inner hole (21) of the lower nest (2) through the radial channel (22) of the lower nest (2) to adequately support the umbrellas post (3) inside the inner hole (21) of the lower nest (2); the end plane of said extending rod (51) penetrated into the inner hole (21) of the lower nest (2) is arcuate; furthermore, the number of the extending rod can be one, two or more to be disposed on different strutting ribs (5) according to the situation of usage.

Figure 2:
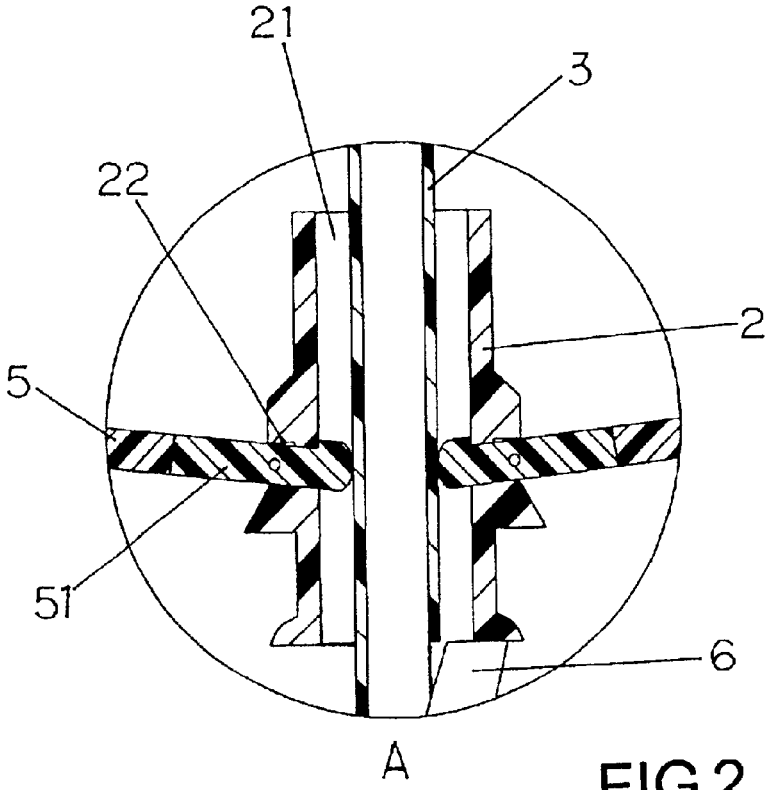
FIG. 2 is an enlarged drawing of area A in FIG. 1.

As shown in FIGS. 1 and 2, when opening the umbrella, the extending rod (51) disposed on one end of the strutting rib (5) adequately supports the umbrella post (3) along the radial channel (22) of the lower nest (2) to prevent it from swing inside the inner hole (21) of the lower nest (2); since the extending rods (51) are symmetrically disposed, the umbrella post (3) will be fixed on the axial line of the inner hole (21) of the lower nest (2) to prevent the changes of the relative surfaces of the opening fastener (6) and the lower end of the lower nest (2) so as to assure that the opening fastener (6) smoothly supports the lower nest (2), thereby to enable the strutting rib (5) connected to the lower nest (2) to support the inner main rib (4) and the outer main rib (7) for holding up the canopy and achieving the objective of opening the umbrella.

Figure 3:
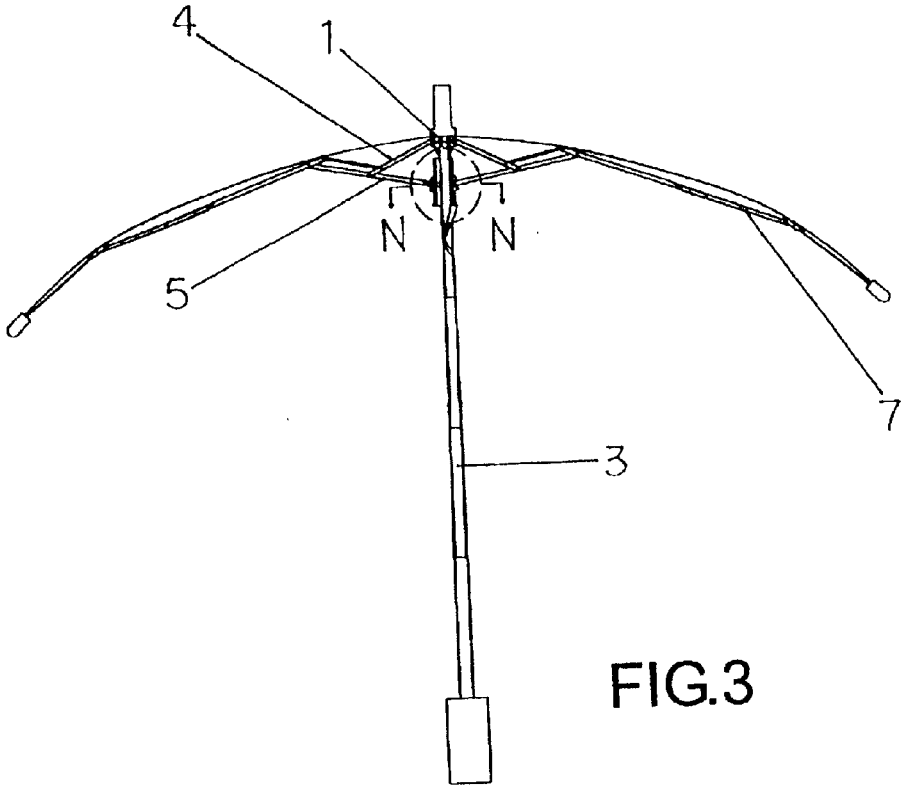
FIG. 3 is a schematic drawing of another state of the practical and innovative umbrella opening of the present invention.
Figure 4:
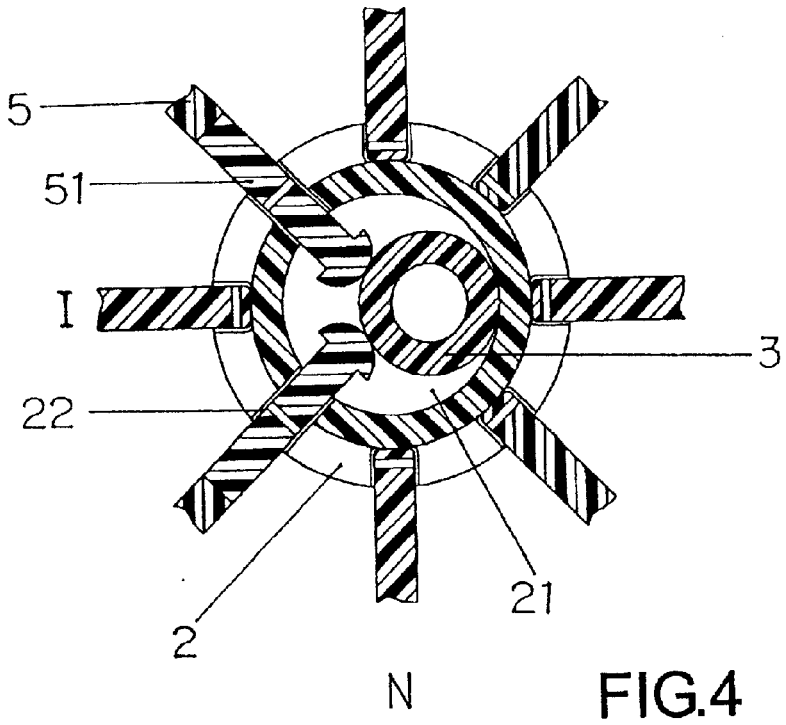
FIG. 4 is a cross-sectional drawing of the state shown along line N—N in FIG. 3.

As shown in FIGS. 3 and 4, the said extending rod (51) is disposed on two strutting ribs (5) located on the opposite side of the opening fastener (6); when opening the umbrella, the said umbrella post (3) will lean closer to one side of the inner hole (21) of the lower nest (2) due to the action of the extending rod (51) so as to increase the mutual supporting surfaces of the opening fastener (6) located on that side and the lower end of the lower nest (2) as well as to further enable the opening fastener (6) to specifically support the lower nest (2) thereby to make the strutting rib (5) connected to the lower nest (2) support the inner main rib (4) and the outer main rib (7) for smoothly holding up the canopy and achieving the objective of opening the umbrellas; furthermore, the said extending rod (51) can also be disposed as a single rod, as a strutting rib (I) shown in FIG. 4; the end plane of the extending rod (51) has to be properly increased for this formation.

Figure 5:
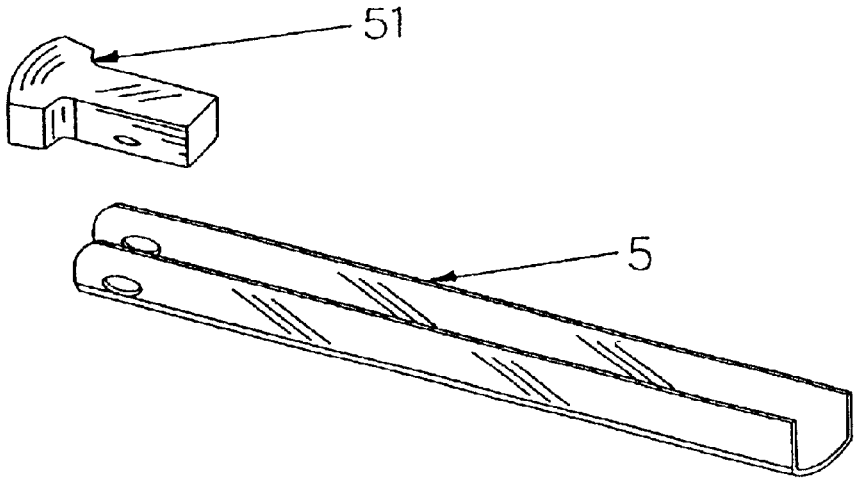
FIG. 5 is a pictorial and exploded drawing of the hinged connection between an extending rod (51) and an U-shaped strutting rib (5).
Figure 6:
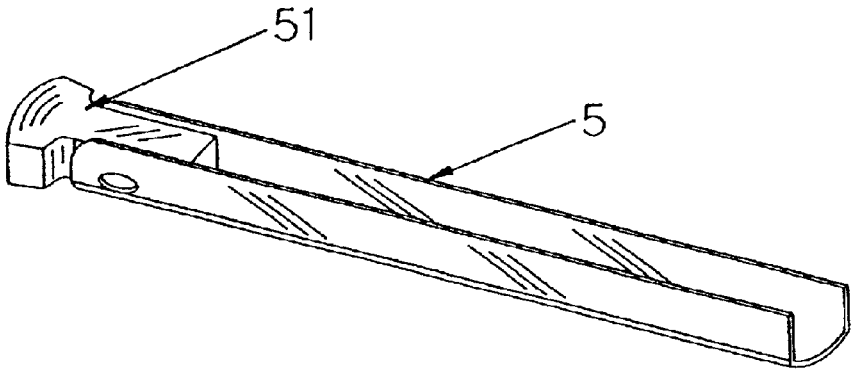
FIG. 6 is a pictorial drawing of the hinged connection between the extending rod (51) and the U-shaped strutting rib (5).
Figure 7:
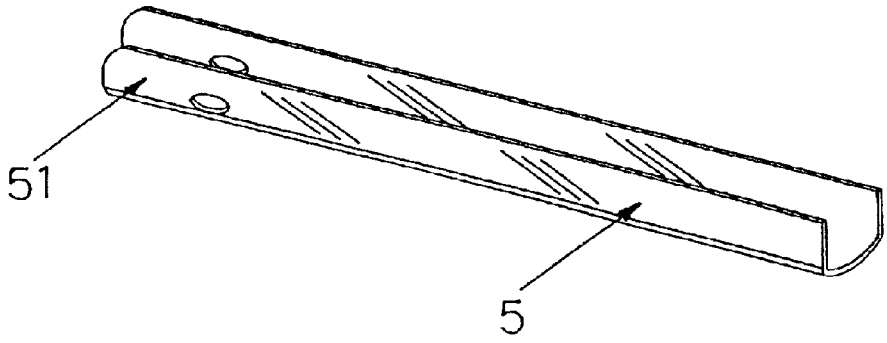
FIG. 7 is a pictorial drawing of the unitary mold of the extending rod (51) and the U-shaped strutting rib (5).

Two kinds of connections between the extending rod (51) and the U-shaped strutting rib (5) are shown in FIGS. 5–7; FIGS. 5 and 6 indicate the crossed connection between the extending rod (51) and the U-shaped strutting rib (5); that means, one portion of the extending rod (51) is inserted into the U-shaped slot of the U-shaped strutting rib (5) and crossly connected therewith; thereby, when in use, FIGS. 1–4 indicate that the said extending rod (51) directly penetrates into the inner hole (21) of the lower nest (2) through the corresponding radial channel (22) on the lower nest (2); FIG. 7 indicates that the extending rod (51) and the U-shape strutting rib (5) are unitarily molded, that means, the said extending rod (51) is formed by extending one end of the U-shaped strutting rib (5).

Figure 8:
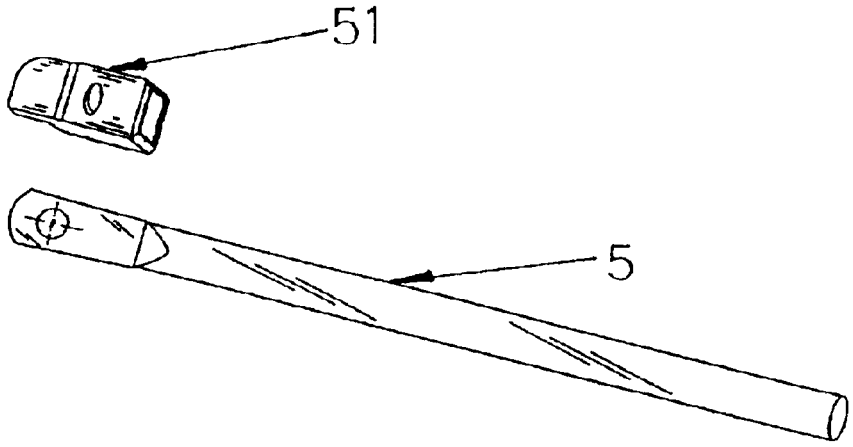
FIG. 8 is an exploded drawing of the hinged connection between the extending rod (51) and the strutting rib (5) in the form of a solid rod.
Figure 9:
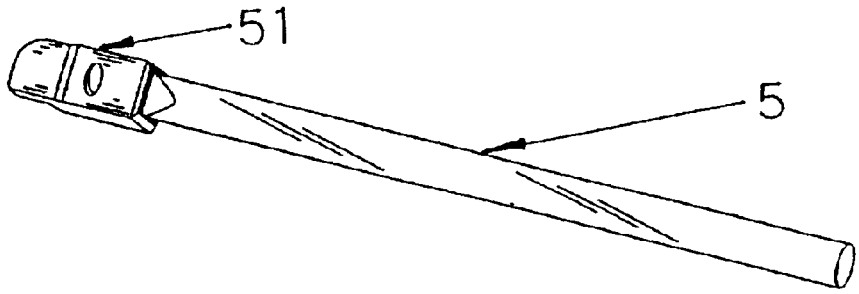
FIG. 9 is a pictorial drawing of the hinged connection between the extending rod (51) and the strutting rib (5) in the form of a solid rod.
Figure 10:
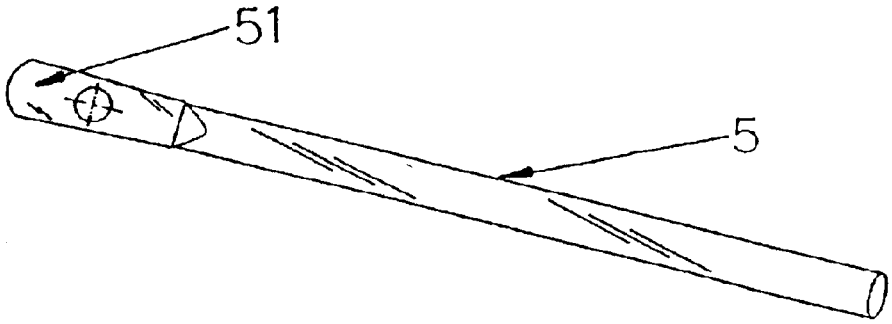
FIG. 10 is a pictorial drawing of the unitary mold of the extending rod (51) and the strutting rib (5) in the form of a solid rod.

Two kinds of connections between the extending rod (51) and the strutting rib (5) in a solid rod are shown in FIGS. 8–10; FIGS. 8 and 9 indicate the engagement between the extending rod (51) and the strutting rib (5) of a solid rod; wherein, the jointing end of the strutting rib (5) is flat and inserted into a concave slot of the extending rod (51) for engagement; FIGS. 1–4 indicate that the said extending rod (51) directly penetrates into the inner hole (21) of the lower nest (2) through the corresponding radial channel (22) on the lower nest (2); FIG. 10 indicates that the extending rod (51) and the strutting rib (5) of a solid rod are unitarily molded, that means, the said extending rod (51) is formed by extending one end of the strutting rib (5) of a solid rod.

Figure 11:
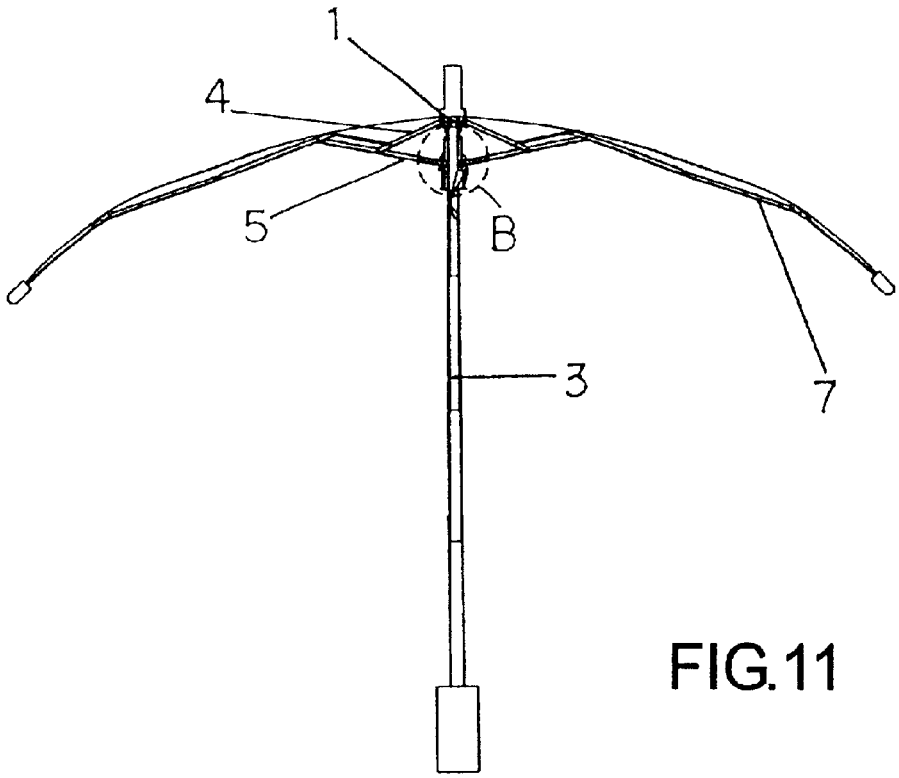
FIG. 11 is a schematic drawing of the practical and innovative present invention applied to opening another multiple-fold umbrella.
Figure 12:
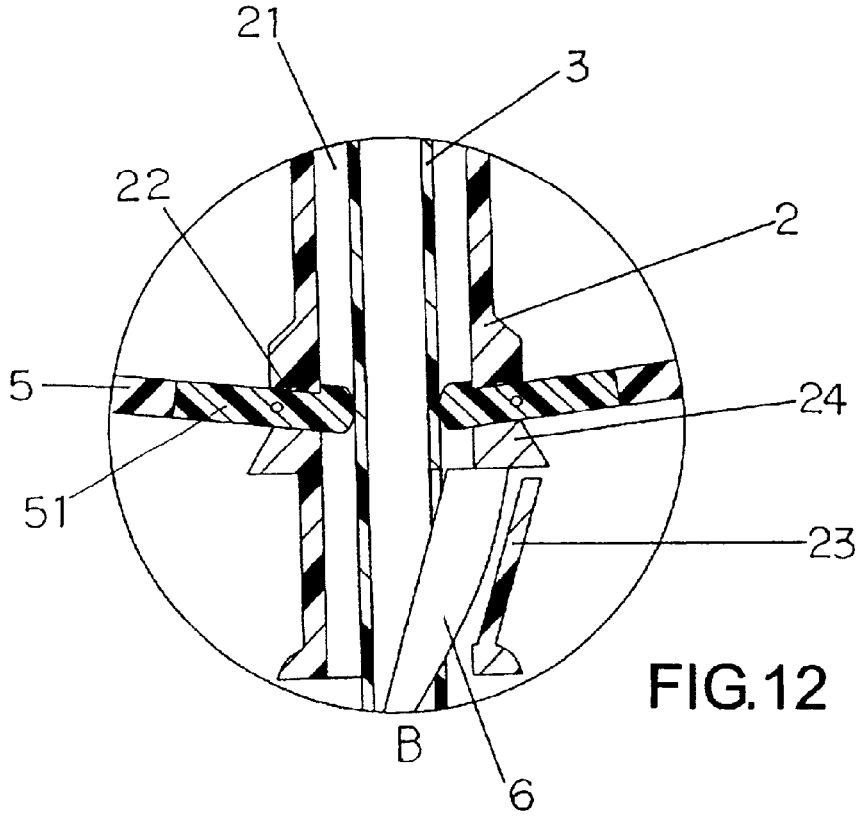
FIG. 12 is an enlarged drawing of area B in FIG. 11.

FIGS. 11 and 12 indicate that the fastening structure for opening an umbrellas of the present invention is applied to another foldable umbrella; the opening fastener (6) inside the umbrella post (3) is disposed higher at the upper aspect; a press tab (23) is disposed at the area of the lower nest (2) on the same side of the opening fastener (6); a supporting portion (24) is disposed at the upper aspect of the press tab (23); when opening the umbrella, the extending rod (51) connected to one end of the strutting rib (5) properly supports the umbrella post (3) through the radial channel (22) of the lower nest (2) accordingly; thereby, the supporting portions (24) of the opening fastener (6) and the lower nest (2) have larger mutual supporting surfaces to prevent the umbrella post (3) from deviating, so the opening fastener (6) is capable of specifically supporting the lower nest (2); therefore, the strutting rib (5) connected to the lower nest (2) supports the inner main rib (4) and the outer main rib (7) for holding up the canopy and achieving the objective of opening the umbrella; furthermore, the said extending rod (51) can be also disposed on the strutting rib (5) on the side opposite the opening fastening (6).

Figure 13:
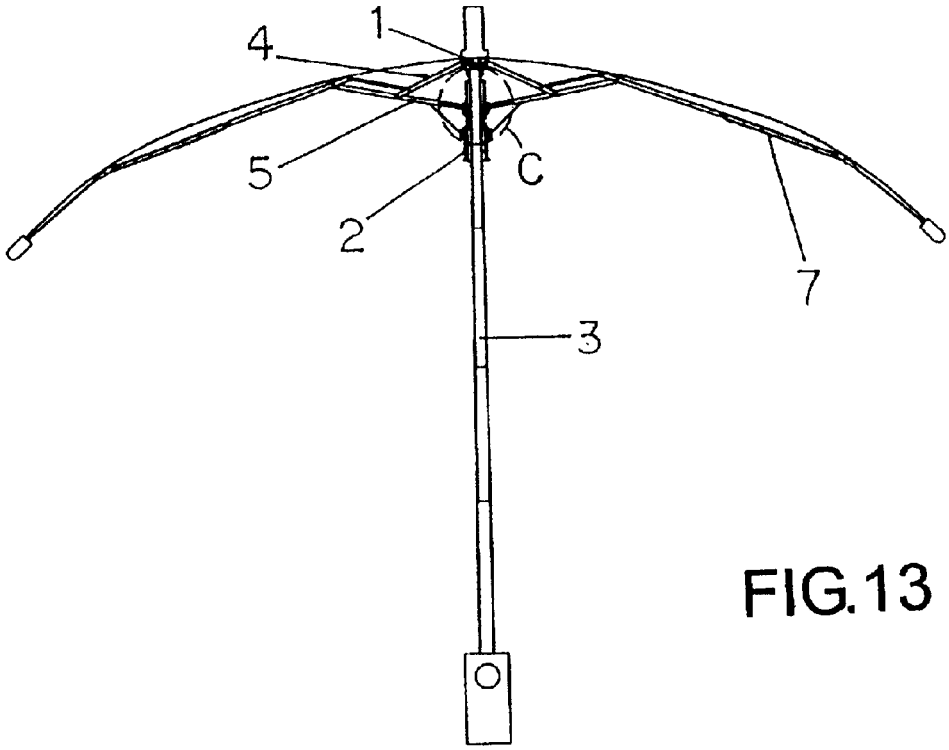
FIG. 13 is a schematic drawing of the practical and innovative present invention applied to opening an automatic and multiple-fold umbrella.
Figure 14:
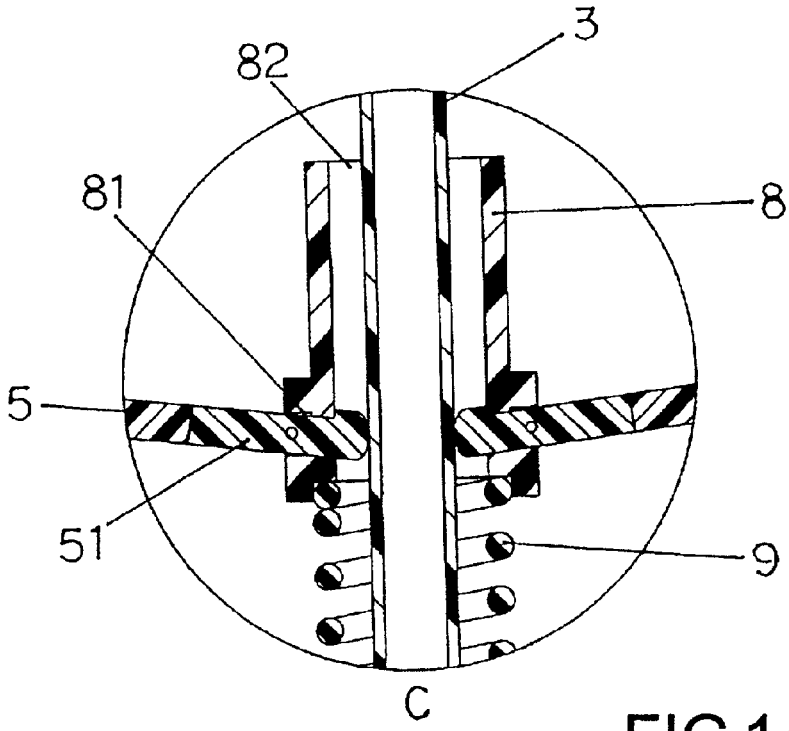
FIG. 14 is an enlarged drawing of area C in FIG. 13.

As shown in FIGS. 13 and 14, the umbrella fastening structure is also applicable to various smaller apertures of tubes disposed below the upper nest (1) of automatic and foldable umbrellas; one end of the umbrella post (3) is fixedly connected to the upper nest (1) and the other end thereof penetrates through the inner holes (82) of the middle nest (8) and the lower nest (2); a spring (9) is disposed between the middle nest (8) and the lower nest (2); the strutting rib (5) is connected onto the middle nest (8); a link rod (25) is disposed on the lower nest (2) to connect with the strutting rib (5) on the middle nest (8) allowing the middle nest (8) and the lower nest (2) to slide on the umbrella post (3); an extending rod (51) is disposed on the jointing ends of the strutting rib (5) and the middle nest (8); a radial channel (81) is disposed at the connecting area of the middle nest (8) and the strutting rib (5); the extending rod (51) penetrates through the radial channel (81) of the middle nest (8) and into the inner hole (82) of the middle nest (8); when opening the umbrella, the extending rod (51) connected onto the strutting rib (5) properly supports the umbrella post (3) from the radial channel (81) of the middle nest (8) accordingly to keep the umbrellas post (3) stay at a fixed position so as to facilitate the umbrella application.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A fastening structure for an umbrella comprising:

a) an upper nest;

b) a lower nest having a inner through hole and at least one radial channel, the at least one radial channel extending inwardly from an outer periphery of the lower nest and communicating with the inner through hole;

c) an umbrella post slidably inserted into the inner through hole of the lower nest and fixedly connected to the upper nest at a first end thereof;

d) a plurality of outer main ribs;

e) a plurality of strutting ribs, each of the plurality of strutting ribs pivotally connected at a first end to the lower nest and at a second end to one of the plurality of the outer main ribs;

f) a plurality of inner main ribs, each of the plurality of inner ribs pivotally connected at a first end to the upper nest and at a second end to a middle portion of one of the plurality of strutting ribs; and g) at least one extending rod connected to a first end of one of the plurality of strutting ribs and inserted into the inner through hole of the lower nest through one of the at least one radial channel, the at least one extending rod releasably engaging the umbrella post.

2. The fastening structure according to claim 1, wherein the at least one extending rod is integrally made with one of the plurality of strutting ribs.

3. The fastening structure according to claim 1, wherein the plurality of strutting ribs have a U-shaped cross section.

4. The fastening structure according to claim 1, wherein the plurality of strutting ribs are a solid rod body.

* * * * *